US011692394B2

(12) United States Patent
Arkenstedt et al.

(10) Patent No.: US 11,692,394 B2
(45) Date of Patent: Jul. 4, 2023

(54) APPARATUS FOR VERTICALLY CLOSING AN OPENING AND METHOD FOR IDENTIFYING A SERVICE NEED AND/OR A SAFETY ISSUE FOR THE SAME

(71) Applicant: Dimon Systems AB, Vellinge (SE)

(72) Inventors: Anders Arkenstedt, Höllviken (SE); Anders Ruuswik, Vellinge (SE)

(73) Assignee: DIMON SYSTEMS AB, Vellinge (SE)

( * ) Notice: Subject to any disclaimer, the term of this patent is extended or adjusted under 35 U.S.C. 154(b) by 465 days.

(21) Appl. No.: 16/093,308

(22) PCT Filed: Apr. 12, 2017

(86) PCT No.: PCT/EP2017/058810

§ 371 (c)(1),
(2) Date: Oct. 12, 2018

(87) PCT Pub. No.: WO2017/178539

PCT Pub. Date: Oct. 19, 2017

(65) Prior Publication Data

US 2020/0284092 A1 Sep. 10, 2020

(30) Foreign Application Priority Data

Apr. 14, 2016 (SE) ..... 1650502-6

(51) Int. Cl.

| | |
|---|---|
| ***E06B 9/68*** | (2006.01) |
| ***E06B 9/08*** | (2006.01) |
| ***E06B 9/58*** | (2006.01) |

(52) U.S. Cl.

CPC ..... *E06B 9/68* (2013.01); *E06B 9/08* (2013.01); *E06B 9/58* (2013.01); *E06B 2009/6818* (2013.01); *E06B 2009/6845* (2013.01)

(58) Field of Classification Search

CPC ..... E06B 2009/6809; E06B 2009/6836; E06B 2009/6818; E06B 2009/6845; E06B 9/68;
(Continued)

(56) References Cited

U.S. PATENT DOCUMENTS 4,974,658 A * 12/1990 Komatsu ..... E06B 9/72 160/264
5,925,996 A * 7/1999 Murray ..... H02H 7/0851 318/471

(Continued)

FOREIGN PATENT DOCUMENTS

EP 1467479 A1 10/2004
EP 1972751 A2 9/2008

(Continued)

OTHER PUBLICATIONS

EL Tilt Sensor; 2011; retrieved from https://durhamgeo.com/pdf/manuals/el-tilt-and-beam-sensor.pdf (Year: 2011).*

(Continued)

*Primary Examiner* — Abe Massad
(74) *Attorney, Agent, or Firm* — Moser Taboada

(57) ABSTRACT

This invention relates to an apparatus for vertically closing an opening, the apparatus comprising a fixed element attached to a surface and placed above an opening such as a window, doorway, or the like. The apparatus further comprising a roller connected to said fixed element, a shielding element attached to the roller, the shielding element being adapted to be wound on and unwound from the roller. The apparatus further comprising a number of sensor arrangements and a condition monitoring device configured to receive data from at least one of the number of sensor arrangements and to directly or indirectly compare the data with reference data such that a service need and/or a safety issue can be identified.

13 Claims, 4 Drawing Sheets

(58) Field of Classification Search
CPC ..... E06B 9/11; E06B 9/13; E06B 9/17; E06B 9/72; E05F 15/40; E05F 15/70
See application file for complete search history.

(56) References Cited

U.S. PATENT DOCUMENTS

| | | | | |
|---|---|---|---|---|
| 6,014,307 | A | 1/2000 | Crimmins | |
| 6,107,765 | A | 8/2000 | Farris et al. | |
| 6,118,243 | A * | 9/2000 | Reed | E05F 15/41 49/28 |
| 6,215,265 | B1 * | 4/2001 | Wolfer | H02H 7/0851 318/434 |
| 6,850,822 | B2 * | 2/2005 | Parsadayan | G05B 9/02 318/473 |
| 7,389,807 | B2 * | 6/2008 | Nagare | E06B 9/13 160/273.1 |
| 8,026,809 | B2 * | 9/2011 | Schafer | E06B 9/68 340/545.7 |
| 8,907,608 | B2 * | 12/2014 | Krupke | E05F 15/684 318/434 |
| 9,038,693 | B2 * | 5/2015 | Gonzales | A62C 37/40 160/7 |
| 9,057,779 | B2 * | 6/2015 | Pfiffner | G01S 17/08 |
| 9,284,775 | B2 * | 3/2016 | Pimenov | E06B 9/68 |
| 9,493,984 | B2 * | 11/2016 | Casey | E06B 9/581 |
| 9,529,345 | B2 * | 12/2016 | Cregg | E06B 9/68 |
| 2003/0121730 | A1 | 7/2003 | Lence-Barreiro et al. | |
| 2003/0217894 | A1 | 11/2003 | Perala et al. | |
| 2004/0210327 | A1 | 10/2004 | Robb | |
| 2007/0016332 | A1 | 1/2007 | Perala et al. | |
| 2008/0224642 | A1 | 9/2008 | Bennett et al. | |
| 2010/0242368 | A1 * | 9/2010 | Yulkowski | E05F 15/40 49/349 |
| 2013/0118695 | A1 * | 5/2013 | Adams | E06B 9/72 160/310 |
| 2013/0186001 | A1 * | 7/2013 | Cui | E05F 15/77 49/31 |
| 2014/0090787 | A1 * | 4/2014 | Colson | E06B 9/42 160/7 |
| 2014/0305600 | A1 | 10/2014 | Casey et al. | |
| 2014/0345812 | A1 * | 11/2014 | Casey | E06B 9/13 160/405 |
| 2015/0077219 | A1 | 3/2015 | Keller et al. | |
| 2015/0160626 | A1 | 6/2015 | Cregg et al. | |
| 2015/0218883 | A1 * | 8/2015 | Hanuka | E06B 9/56 160/10 |
| 2015/0364969 | A1 * | 12/2015 | Brondex | E06B 9/68 160/310 |
| 2017/0284157 | A1 * | 10/2017 | Blair | E06B 9/17 |

FOREIGN PATENT DOCUMENTS

| | | | |
|---|---|---|---|
| EP | 2506034 | A1 | 10/2012 |
| EP | 2813911 | A1 | 12/2014 |
| JP | 2001152767 | A | 6/2001 |

OTHER PUBLICATIONS

International Search Report dated Jul. 17, 2017 for PCT Application No. PCT/EP2017/058810.
Swedish Search Report for application No. 1650502-6 dated Nov. 10, 2016.

* cited by examiner

APPARATUS FOR VERTICALLY CLOSING AN OPENING AND METHOD FOR IDENTIFYING A SERVICE NEED AND/OR A SAFETY ISSUE FOR THE SAME

TECHNICAL FIELD

The present inventive concept relates to the field of vertical closures and condition monitoring of the same. More particularly, it is disclosed an apparatus for vertically closing an opening, and related methods, systems, and devices.

BACKGROUND

Arrangements for vertical closures are used in industrial facilities, commercial and public buildings, residential houses, and the like, typically to cover doorways and windows for the purpose of protecting against vandalism, burglary, fire, and climatic variations.

A typical vertical closure comprises a mounting frame placed above the opening to be closed and a door leaf able to be wound on and unwound from a roller attached to the mounting frame. The movement of the door leaf is often controlled by a simple circuit switch. Some closures include guiding rails parallel to the opening for guiding the door leaf between its wound and unwound state.

The components belonging to a vertical closure wear and might also fail over the course of time. The closure may also originally have been mounted or adjusted in a wrong way. A failure of a critical component such as the mounting frame imposes a severe risk of injuring people should the closure fall down. Further, any failure preventing the closure from opening and closing as intended requires extensive trouble-shooting to establish the cause of failure, during which the closure does not serve its intended purpose.

SUMMARY OF THE INVENTION

It is an object of the present inventive concept to mitigate, alleviate, or eliminate one or more of the above-identified deficiencies in the art and disadvantages singly or in combination.

According to a first aspect of the inventive concept, these and other objects are achieved in full, or at least in part, by an apparatus for vertically closing an opening, the apparatus comprising a fixed element attached to a surface and placed above an opening such as a window, doorway, or the like. The apparatus further comprising a roller connected to the fixed element; a shielding element attached to the roller, the shielding element being adapted to be wound on and unwound from the roller, the shielding element being configured to be in a first state when the opening is covered by the shielding element and thereby closed, and a second state when the opening is open. The apparatus further comprising a motor configured to drive the roller such that the shielding element can be moved between the first and second state; a number of sensor arrangements; a condition monitoring device configured to receive data from at least one of the number of sensor arrangements and to directly or indirectly compare the data with reference data such that a service need and/or a safety issue can be identified.

At least one of the number of sensor arrangements may be capable of detecting a vertical position of the shielding element.

At least one of the number of sensor arrangements may be capable of detecting an inclination of the fixed element about at least one axis.

At least one of the number of sensor arrangements may be capable of detecting a position of the roller relative the fixed element.

The apparatus may comprise a first and a second guiding element, and at least one of the number of sensor arrangements may be capable of detecting a position of the shielding element along at least one horizontal axis relative to at least one of the first and the second guiding element.

The apparatus may comprise a switch for controlling the motor, and at least one of the number of sensor arrangements may be capable of detecting a signal failure between the switch and the motor.

At least one of the number of sensor arrangements may be capable of detecting a number of starts and/or stops and/or time of operating of the motor.

The apparatus may comprise a thermal circuit breaker, and at least one of the number of sensor arrangements may be capable of detecting the state of the thermal circuit breaker.

The service need and/or the safety issue may be identified by comparing data from one of the number of sensor arrangements to the reference data.

The service need and/or the safety issue may be identified by comparing data from a combination of the number of sensor arrangements to the reference data.

The condition monitoring device may be further configured to fine tune the motor.

The condition monitoring device may be configured to transmit the received data to and receive the reference data from an on-site located data node.

At least one of the number of sensor arrangements may be an electric current sensor configured to determine an electric current fed to the motor.

At least one of the number of sensor arrangements may be a temperature sensor configured to determine a temperature in the motor.

At least one of the number of sensor arrangements may be a vibration sensor configured to determine a vibration of the apparatus.

The number of sensor arrangements may be configured to determine a state of at least one of a circuit switch, a remote controller, a radar controller, a safety edge, a photocell, a limit switch, and a kill switch According to a second aspect of the inventive concept, these and other objects are achieved in full, or at least in part, by a system comprising at least one apparatus according to the above; at least one on-site located data node; and a database. The at least one data node is configured to communicate with the condition monitoring device of the at least one apparatus, and to communicate with the database.

The database may be a remotely placed cloud service.

The system may comprise at least two apparatuses according to the above, wherein the at least two apparatuses are configured to exchange information with each other.

According to a third aspect of the inventive concept, these and other objects are achieved in full, or at least in part, by a method for identifying a service need and/or a safety issue for an apparatus for vertically closing an opening. The apparatus comprises a fixed element attached to a surface and placed above an opening such as a window, doorway, or the like. The apparatus further comprises a roller connected to the fixed element; a shielding element attached to the roller, the shielding element being adapted to be wound an unwound on and from the roller, the shielding element being configured to be in a first state when the opening is covered by the shielding element and thereby closed, and a second state when the opening is open; a motor configured to drive the roller such that the shielding element can be moved between the first and second state; a number of sensor arrangements; a condition monitoring device configured to receive data from at least one of the number of sensor arrangements. The method comprises collecting data from the number of sensor arrangements; comparing the data with reference data in order to identify a service need and/or a safety issue; and generate a condition notification and/or safety issue notification.

The step of comparing the data with reference data may be performed at least by the condition monitoring device and/or an on-site located data node and/or a database and/or a computing device connected to the database.

The method may further comprise the step of updating the reference data using the data.

According to a fourth aspect of the inventive concept, these and other objects are achieved in full, or at least in part, by a condition monitoring device configured to receive data from a sensor arrangement for monitoring an arrangement for vertically closing an opening, the condition monitoring device being further configured to directly or indirectly compare the data with reference data such that a service need and/or a safety issue of the arrangement can be identified.

Other objectives, features and advantages of the present invention will appear from the following detailed disclosure, from the attached claims as well as from the drawings.

Generally, all terms used in the claims are to be interpreted according to their ordinary meaning in the technical field, unless explicitly defined otherwise herein. All references to "a/an/the [element, device, component, means, step, etc]" are to be interpreted openly as referring to at least one instance of said element, device, component, means, step, etc., unless explicitly stated otherwise. The steps of any method disclosed herein do not have to be performed in the exact order disclosed, unless explicitly stated.

BRIEF DESCRIPTION OF THE DRAWINGS

The above, as well as additional objects, features and advantages of the present invention/inventive concept, will be better understood through the following illustrative and non-limiting detailed description of different embodiments of the present invention/inventive concept, with reference to the appended drawings, wherein.

DETAILED DESCRIPTION

Figure 1:
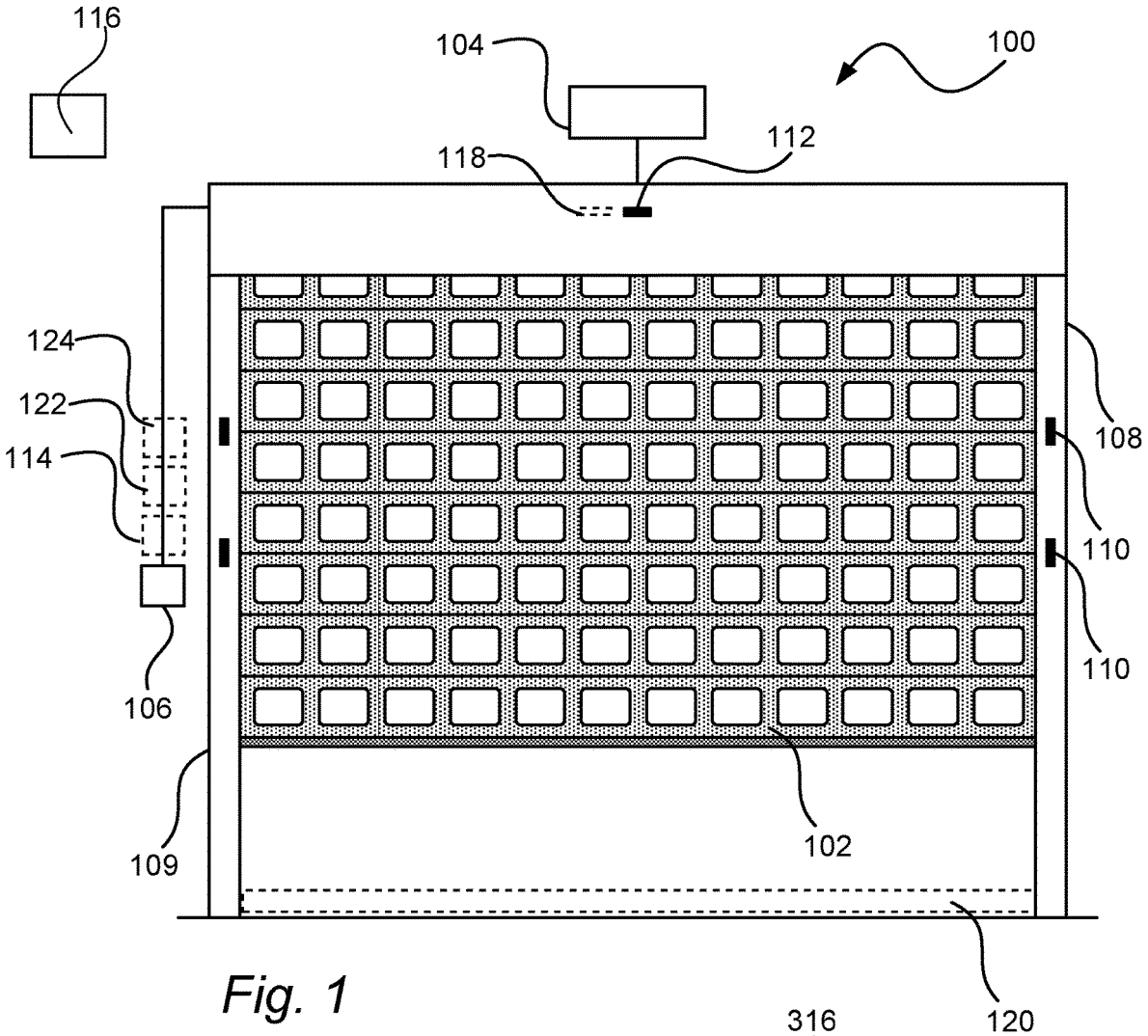
FIG. 1 illustrates an example of an apparatus for vertically closing an opening.

FIG. 1 illustrates an example of an apparatus 100 for vertically closing an opening. The apparatus 100 comprises a fixed element attached to a surface and placed above an opening. A roller is connected to the fixed element, and a shielding element 102 is attached to the roller. Here, the shielding element 102 is made from several rigid, perforated slats. However, the shielding element 102 may comprise other elements, such as solid slats, grids, or flexible curtains. The shielding element 102 is adapted to be wound on and unwound from the roller, the shielding element 102 being configured to be in a first state when the opening is covered by the shielding element 102 and thereby closed, and a second state when the opening is open. The fixed element may be attached to and placed on a vertical surface, such as a wall, and/or a horizontal surface, such as a ceiling. The apparatus 100 comprises a motor configured to drive the roller such that the shielding element 102 can be moved between the first and second state. The apparatus 100 may comprise a first and a second guiding element 108, 109, for guiding the shielding element 102 along the opening. The apparatus 100 may optionally comprise a fixed casing at least partially encasing the roller. It is to be understood that the fixed element may be attached under an upper end of the opening, or in line with an upper end of the opening, as long as the roller is positioned above the opening such that the shielding element 102 can be moved between the first and second state. The motor may be a tubular motor. The motor may be placed inside of the roller.

The apparatus 100 may comprise a number of sensor arrangements. The apparatus 100 may comprise a condition monitoring device 104 configured to receive data from at least one of the number of sensor arrangements. The condition monitoring device 104 may directly or indirectly compare the data with reference data such that a service need and/or a safety issue can be identified. The phrase "directly compare the data with reference data" should be interpreted to imply that the data is compared with reference data by the condition monitoring device 104. The phrase "indirectly compare the data with reference data" should be interpreted to imply that the data is compared with reference data by another device, such as an on-site located data node, and/or a database, and/or a computer connected to the database. The comparison of data with reference data may be made by the condition monitoring device 104, and/or the on-site located data node, and/or the database, and/or a computer connected to the database.

The apparatus 100 may comprise a sensor arrangement 110 capable of detecting a vertical position of the shielding element 102. The sensor arrangement 110 may comprise a photocell and/or a magnetic contact switch and/or an imaging device. The sensor arrangement 110 may be configured such that it is possible to determine a velocity of the shielding element 102. For example, the sensor arrangement 110 may comprise two sensors positioned apart along a vertical axis on the first guiding element as shown in FIG. 1, and a difference in time as the shielding element 102 passes the sensors may be detected. The shielding element 102 may comprise a structural profile such that the sensor arrangement 110 is capable of detecting a movement of the shielding element 102. The sensor arrangement 110 may be configured to detect a number of revolutions of the roller per unit of time. The sensor arrangement 110 may be positioned on the first and/or second guiding element 108,109. The sensor arrangement 110 may comprise a single sensor. The sensor arrangement 110 may be positioned inside of the fixed case. The sensor arrangement 110 may comprise sensors positioned on the first and second guiding element 108, 109, making it possible to determine if the shielding element 102 and/or the roller and/or the fixed element is level. For example, if the shielding element 102 is not level, it may be able to, simultaneously, travel a first distance along the first guiding element 108 and a second distance along the second guiding element 109, wherein the first and second distance is different.

The apparatus 100 may comprise a switch 106 for controlling the motor. The switch 106 may be a key-operated switch. The switch 106 may communicate with the motor wirelessly. The apparatus 100 may comprise a switch sensor arrangement capable of detecting a signal failure between the switch 106 and the motor.

The apparatus 100 may comprise at least one of a circuit switch 114, remote controller 116, a radar controller 118, a safety edge 120, a limit switch 122 and a kill switch 124. In this case, the number of sensor arrangement 110, 112 may be configured to determine a state of at least one of the circuit switch 114, the remote controller 116, the radar controller 118, the safety edge 120, the limit switch 122 and the kill switch 124.

The apparatus 100 may comprise a motor sensor arrangement capable of detecting a number of starts and/or stops and/or time of operating of the motor. The motor sensor arrangement may be capable of detecting an electric current fed to the motor. The motor sensor arrangement may be capable of detecting a voltage drop across the motor. The motor sensor arrangement may be capable of detecting an electric current spike fed to the motor. The motor sensor arrangement may be capable of detecting a time of operating of the motor during a pre-determined time window. The motor sensor arrangement may be capable of detecting whether a backup battery is supplying the motor with power. The motor sensor arrangement may be capable of detecting a power level of the backup battery.

The apparatus 100 may comprise a thermal circuit breaker. The apparatus 100 may comprise a thermal circuit breaker sensor arrangement capable of detecting the state of the thermal circuit breaker.

The apparatus 100 may comprise a sensor arrangement 112 capable of detecting an inclination of the fixed element about at least one axis, such as three mutually perpendicular axes. The sensor arrangement 112 may comprise an accelerometer. By detecting an inclination of the fixed element, it may be possible to determine whether the fixed element is coming loose from its attachment to the surface, and/or whether the fixed element has been properly installed. The sensor arrangement 112 may be capable of detecting vibrations in the fixed element. The vibrations may be caused by a winding and/or unwinding of the shielding element 102.

The apparatus 100 may comprise an emergency shutdown switch. The apparatus 100 may comprise an emergency shutdown switch sensor arrangement capable of detecting the state of the emergency shutdown switch.

The apparatus 100 may comprise a vibration sensor arrangement capable of detecting vibrations in the apparatus 100.

The condition monitoring device 104 may be configured to fine tune the motor. For example, a motor voltage and/or motor current may be changed. In yet another example, a torque profile of the motor may be changed such that the torque of the motor is low directly after a start of the motor and subsequently slowly increases. Such a torque profile may increase the life-time of the motor and/or decrease vibrations in the apparatus 100.

The condition monitoring device 104 may be configured to transmit the received data to and receive the reference data from the on-site located data node and/or the database.

The condition monitoring device 104 may be configured to store data. Hereby, for example in the case of a power outage, data from at least one of the number of sensor arrangements may be stored in the condition monitoring device 104 until the power outage is over, after which data can be transmitted to the on-site located data node and/or the database.

Figure 2:
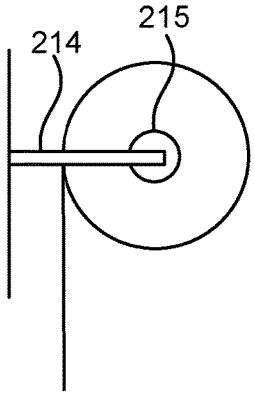
FIG. 2 illustrates part of an apparatus for vertically closing an opening.

Now referring to FIG. 2, part of an apparatus for vertically closing an opening, similar to the apparatus described in conjunction with FIG. 1, is shown. The apparatus may comprise a roller position sensor arrangement capable of detecting a position of the roller 215 relative the fixed element 214 along at least one axis, such as three mutually perpendicular axes. The roller position sensor arrangement may comprise an accelerometer. By detecting a position of the roller 215 relative the fixed element 214, it may be possible to determine whether the roller is coming loose from its attachment to the fixed element 214, and/or whether the roller has been properly installed. The roller position sensor arrangement may be capable of detecting vibrations in the roller. The vibrations may be caused by a winding and/or unwinding of the shielding element 102.

Figure 3:
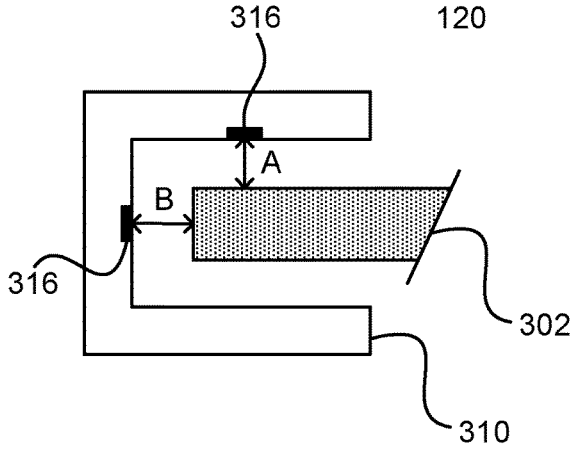
FIG. 3 illustrates another part of an apparatus for vertically closing an opening.

Now referring to FIG. 3, part of an apparatus for vertically closing an opening, similar to the apparatuses described in conjunction with FIGS. 1 and 2, is shown. The apparatus may comprise a guiding element sensor arrangement 316. The guiding element sensor arrangement 316 may be capable of detecting a position of the shielding element 302 along at least one horizontal axis relative at least one of the first and second guiding element 310. The guiding element sensor arrangement 316 may comprise a photocell and/or a magnetic contact switch. The guiding element sensor arrangement 316 may measure a distance A and B between the shielding element 302 and at least one of the first and second guiding element 310. By detecting a position of the shielding element 302 along at least one horizontal axis relative at least one of a first and second guiding element 310, it may be possible to determine whether a fixed element is coming loose from its attachment to a surface, and/or whether the fixed element has been properly installed and/or whether a roller is coming loose from its attachment to the fixed element, and/or whether the roller has been properly installed, as described above in conjunction with FIG. 1. The guiding element sensor arrangement 316 may be capable of detecting an inclination of at least one of the first and second guiding element 310 about at least one axis, such as three mutually perpendicular axes. The guiding element sensor arrangement may comprise an accelerometer. By detecting an inclination of at least one of the first and second guiding element 310, it may be possible to determine whether at least one of the first and second guiding element 310 has been properly installed. The guiding element sensor arrangement may be capable of detecting vibrations in at least one of the first and second guiding element 310. The vibrations may be caused by a winding and/or unwinding of the shielding element 302.

The apparatus may comprise at least two sensor arrangements. Data from the at least two sensor arrangements may be combined in order to increase the certainty of an assumed condition of the apparatus. For example, data from the sensor arrangement 112 may be combined with data from the sensor arrangement 110. Data from the sensor arrangement 110 may indicate that the shielding element 102 is not level, and data from the sensor arrangement 112 may indicate that the fixed element is not inclined. These indications may in combination point away from a problem with the fixed element and towards a problem with the shielding element 102 and/or the roller.

Figure 4:
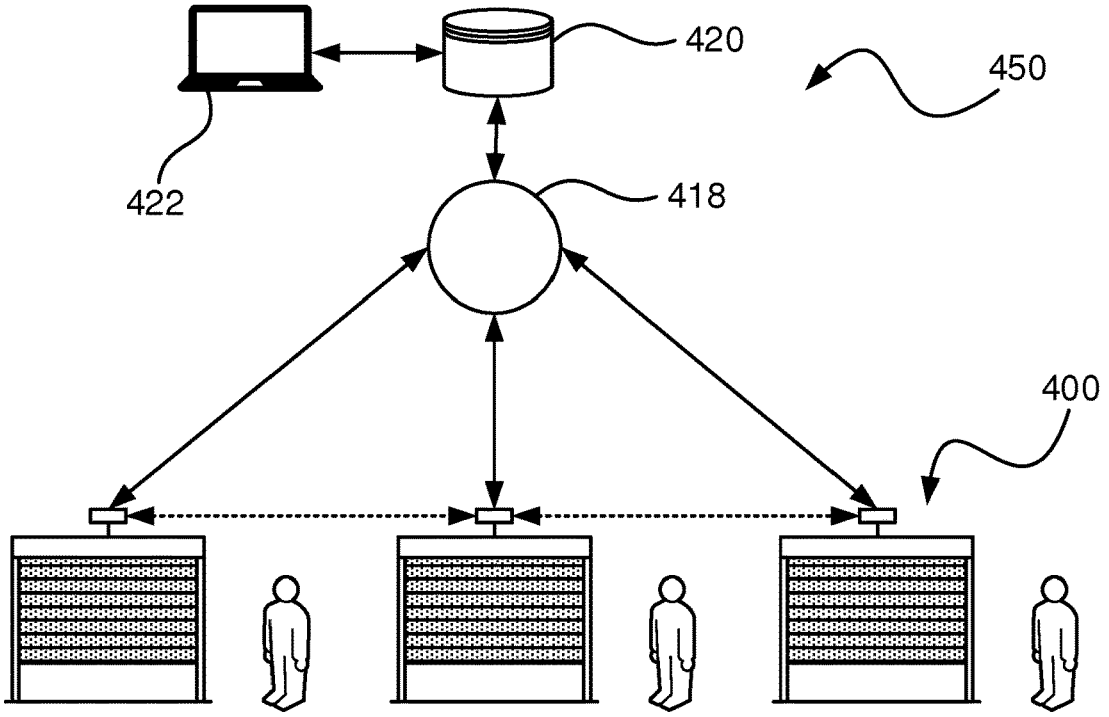
FIG. 4 illustrates a system comprising at least one apparatus for vertically closing an opening, at least one on-site located data node, and a database.

Now referring to FIG. 4, a system 450 comprising at least one apparatus 400 for vertically closing an opening as described in conjunction with FIGS. 1-3, at least one on-site located data node 418, and a database 420, is shown. The at least one data node 418 may be configured to communicate with the condition monitoring device of the at least one apparatus 400, and to communicate with the database 420. The condition monitoring device may be configured to receive data from a number of sensors as described above. The received data may be transmitted to the data node 418. The system 450 may comprise at least two apparatuses 400 as described in conjunction with FIGS. 1-3, wherein the apparatuses are configured to exchange information with each other. Thus, for example, it may be possible for a first apparatus to transmit data through a second apparatus to the data node 418 and/or database 420, without the first apparatus being in direct contact with the data node 418 and/or the database 420. Similarly, the first apparatus may receive reference data from the data node 418 and/or the database 420 through the second apparatus.

The condition monitoring device may directly or indirectly compare the data with reference data such that a service need and/or a safety issue can be identified. The comparison of data with reference data may be made by the condition monitoring device, and/or the on-site located data node 418, and/or the database 420, and/or a computer 422 connected to the database.

Figure 5:
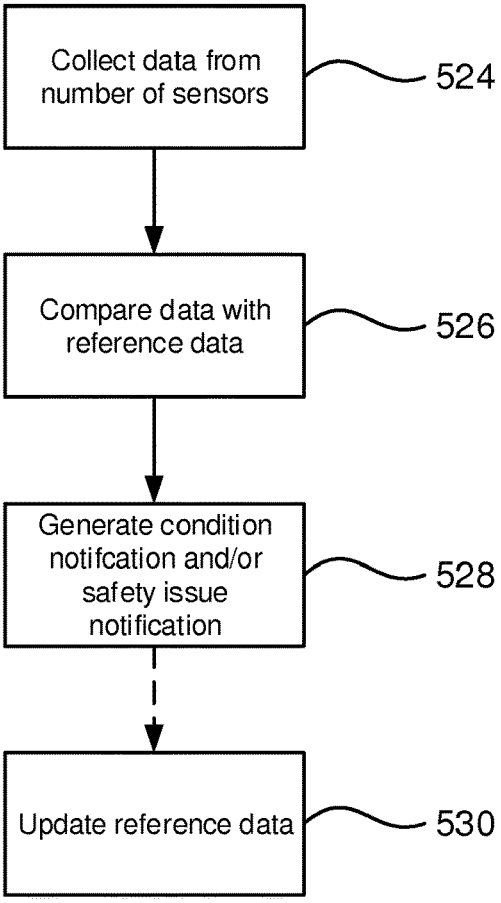
FIG. 5 illustrates a method for identifying a service need and/or a safety issue for an apparatus for vertically closing an opening.

Now referring to FIG. 5, a method for identifying a service need and/or a safety issue for an apparatus for vertically closing an opening, as described in conjunction with FIGS. 1-3, is illustrated. The apparatus comprises a fixed element attached to a surface and placed above an opening such as a window, doorway, or the like. The apparatus comprises a roller connected to the fixed element. The apparatus comprises a shielding element attached to the roller, the shielding element being adapted to be wound and unwound on and from the roller, the shielding element being configured to be in a first state when the opening is covered by the shielding element and thereby closed, and a second state when the opening is open. The apparatus comprises a motor configured to drive the roller such that the shielding element 102 can be moved between the first and second state. The apparatus may optionally comprise a fixed casing at least partially encasing the roller. It is to be understood that the fixed element may be attached under an upper end of the opening, or in line with an upper end of the opening, as long as the roller is positioned above the opening such that the shielding element can be moved between the first and second state. The apparatus may comprise a number of sensor arrangements as described in conjunction with FIGS. 1-4. The apparatus may comprise a condition monitoring device as described in conjunction with FIGS. 1-4.

The method comprises collecting data at 524 from the number of sensor arrangements, comparing the data with reference data at 526 in order to identify a service need and/or a safety issue, and generate a condition notification and/or safety issue notification at 528. The step of comparing the data with reference data may be performed at least by the condition monitoring device and/or an on-site located data node and/or a database and/or a computing device connected to the database. The method may further comprise updating the reference data with the data at 530. Thus, the reference data may come to reflect a normal operating condition of the apparatus. The certainty of the identified service need and/or safety issue may thus increase over time as more data is received from the at least one sensor arrangement. Further, the reference data may be used to predict a need of maintenance of the apparatus for example before a component of the apparatus fail. The reference data may be used to predict a life-time of a component of the apparatus.

Figure 6:
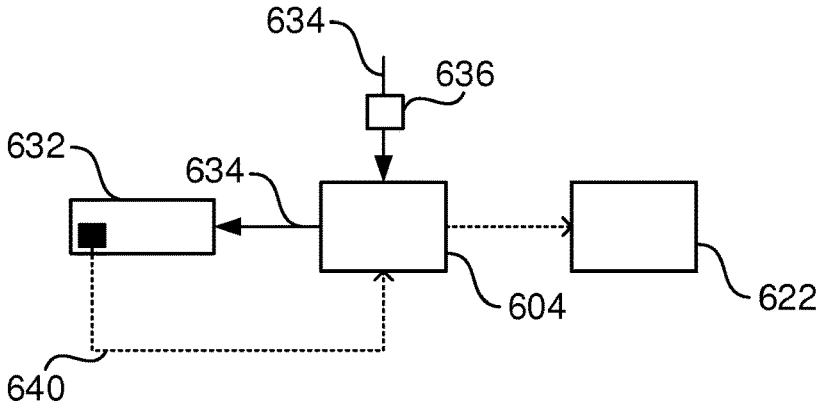
FIG. 6 illustrates an example of how a tubular motor may be monitored.

Now referring to FIG. 6, an example of how a motor 632 of an apparatus for vertically closing an opening may be monitored is illustrated. The motor 632 may be connected to a power source. Electric current 634 delivered by the power source may be monitored by the condition monitoring device 604. The electric current 634 may be determined by an electric current sensor. A circuit switch 636 may control the delivery of electric current 634 fed to the motor 632, and thereby indirectly control an operation of the motor 632. The circuit breaker 636 may control whether the motor is operating, and whether the shielding element is winding on or unwinding from the roller. The electric current 634 delivered by the power source may be monitored by the condition monitoring device 604 at pre-determined time intervals. By determining the electric current 634 fed to the motor, a measure of the electric power transferred to the motor may be determined. However, as is readily understood by the person skilled in the art, the electric power transferred to the motor may be determined through other means than by determining the electric current.

A temperature sensor in the motor 632 may detect a temperature in the motor 632. Data 640 representing a temperature in the motor 632 may be sent to the condition monitoring device 604. Hereby, it may be possible to determine if the motor 632 is close to reaching a temperature wherein a thermal circuit breaker of the motor 632 will engage. The thermal circuit breaker may herein be defined as a security measure in order to prevent the motor 632 from reaching a temperature where the motor 632 will be damaged and/or perform suboptimal. The temperature sensor may be located within the motor. The temperature sensor may be located within the roller.

The apparatus may comprise a vibration sensor configured to determine a vibration of the apparatus, and/or the fixed element, and/or the shielding element, and/or the motor. Vibrations may be caused by a starting and/or stopping of the motor, and/or by a winding or unwinding of the shielding element on and from the roller respectively. The condition monitoring device may be configured to determine whether a vibration exceeds a pre-determined threshold. A vibration may herein be defined as an amplitude of a vibration. Further, the vibration sensor may be configured to detect vibrations in a specific interval of vibration frequencies.

Data 640 representing the temperature in the motor 632 and/or data representing electric current 634 fed to the motor 632 may be directly or indirectly compared with reference data, for example in a computer 622, such that a service need and/or a safety issue can be identified.

Figure 7A:
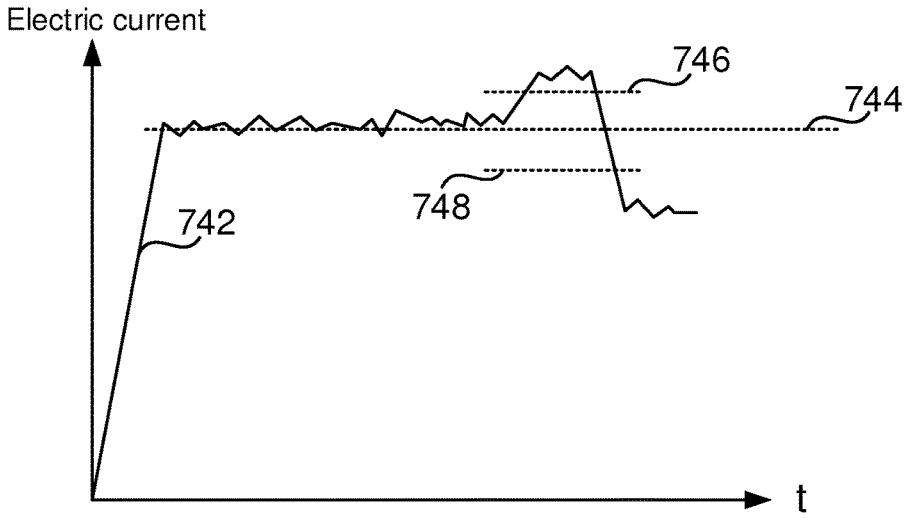
FIGS. 7*a* and 7*b* illustrate electric current fed to a motor over time.

Now referring to FIG. 7*a*, an example of a diagram illustrating electric current 742 fed to the motor over time is shown. The motor may have a baseline 744 with respect to the electric current 742, depending on a type of motor, characteristics of the apparatus in which the motor is located, and/or depending on whether the shielding element is winding on or unwinding from the roller, and/or depending on the position of the shielding element. In the illustrated example, the baseline 744 is constant. However, the baseline 744 may increase and/or decrease over time as the shielding element is wound on or unwound from the roller. The condition monitoring device may detect if the electric current 742 exceeds an upper threshold 746 and/or a lower threshold 748. This may indicate that the apparatus for vertically closing an opening is not operating as intended. Accordingly, a service need and/or a safety issue may hereby be determined.

Figure 7B:
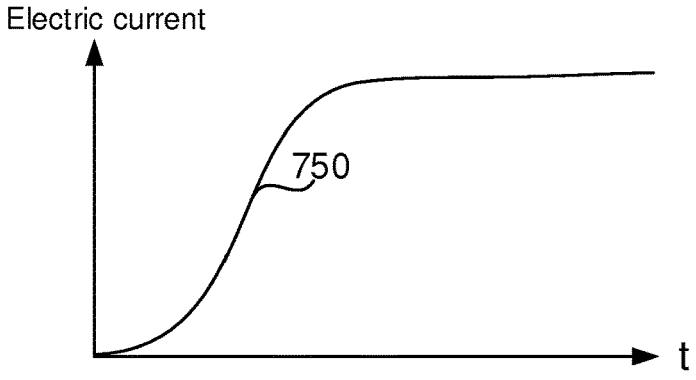

Now referring to FIG. 7*b*, a diagram illustrating electric current 750 fed to the motor over time is shown. In the illustrated example, the motor is stationary at a time zero, represented by the origin of the diagram. When the motor is commanded to operate, the electric current 750 fed to the motor is exponentially increased over time until the electric current has reached an operating level. Hereby, the motor is slowly brought to its operating level of current, and thus slowly brought to its speed of winding or unwinding of the shielding element. Similarly, when the motor is commanded to stop, the electric current may decrease exponentially over time. An advantage of this arrangement is that vibrations in the apparatus associated with a starting or stopping of the motor may be decreased. This arrangement may be defined as a "soft start" or "soft stop" of the motor.

Figure 8:
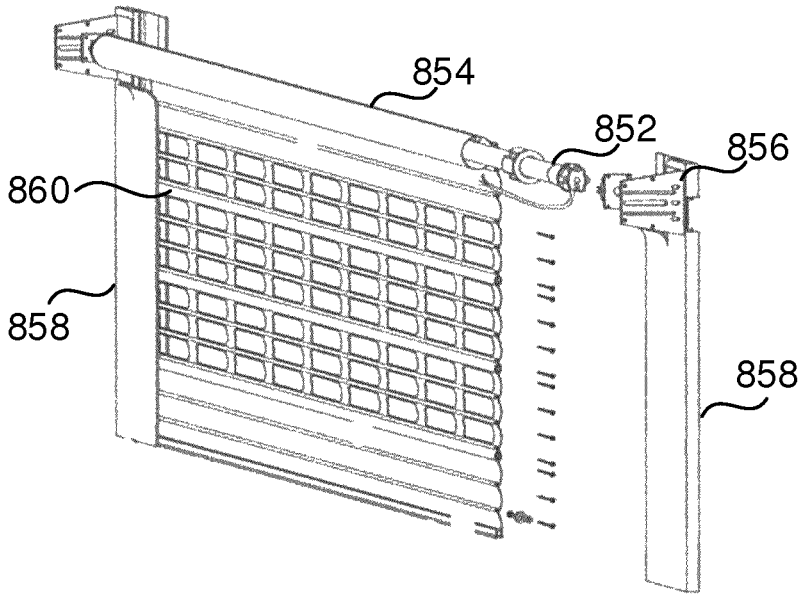
FIG. 8 illustrates an example of an apparatus for vertically closing an opening.

Now referring to FIG. 8, an example of an apparatus for vertically closing an opening is illustrated. The apparatus comprises a tubular motor 852. The tubular motor 852 may be located within a tube 854. The tubular motor 852 may be mounted to a fixed element 856. The apparatus may comprise a shielding element 860 attached to a roller. The tubular motor 852 may be configured to drive the roller such that the shielding element 860 can be wound on and unwound from the roller. The apparatus may comprise a first and second guiding element 858 configured to guide the shielding element 860 during a winding and/or unwinding of the same on the roller.

Figure 9:
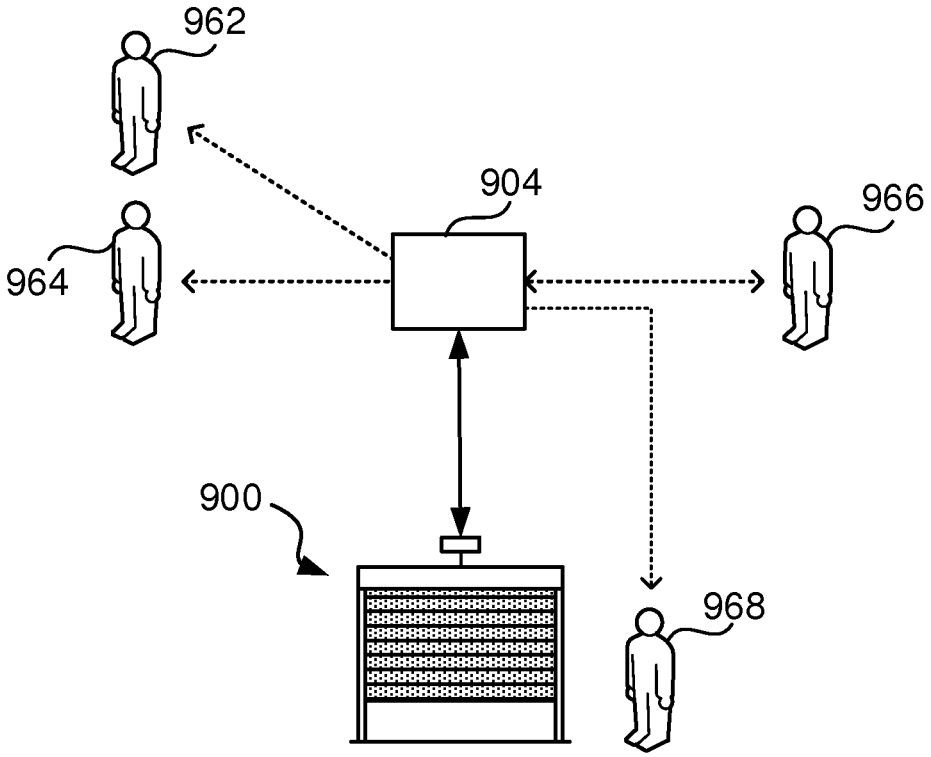
FIG. 9 illustrates an example of how data collected by the condition monitoring device may be used.

Now referring to FIG. 9, an example of how data collected by the condition monitoring device may be used is illustrated. A condition monitoring device of an apparatus 900 for vertically closing an opening may receive data from at least one of a number of sensor arrangements of the apparatus 900. The data may be sent to a computer 904. Hereby, the apparatus 900 may be remotely monitored continuously. Data sent to the computer 904 may be communicated to a service operator 966, and/or a research and development unit 962 associated with the apparatus 900, and/or to a third party 964 having interest in the data collected by the condition monitoring device, and/or to a user 968 of the apparatus 900. Hereby, a condition of the apparatus 900 may be conveyed to any party having interest in such information. Further, a maintenance of the apparatus 900 may be facilitated, since a cause of a problem of the apparatus 900 may be remotely identified. Thus, the correct replacement part may be brought by a technician without the need of the technician first having to examine the apparatus 900 in person.

The invention has mainly been described above with reference to a few embodiments. However, as is readily appreciated by a person skilled in the art, other embodiments than the ones disclosed above are equally possible within the scope of the invention, as defined by the appended patent claims.

LIST OF REFERENCE SIGNS

100 Apparatus
102 Shielding element
104 Condition monitoring device
106 Switch
108 First guiding element
109 Second guiding element
110 Sensor arrangement
112 Sensor arrangement
214 Fixed element
215 Roller
302 Shielding element
310 Guiding element
316 Guiding element sensor arrangement
400 Apparatus
418 Data node
420 Database
422 Computer
450 System
524 Step of collecting data from number of sensors
526 Step of comparing data with reference data
528 Step of generating condition notification and/or safety issue notification
530 Step of updating reference data
632 Motor
634 Electric current
636 Circuit switch
640 Temperature
742 Electric current
744 Baseline
746 Upper threshold
748 Lower threshold
750 Electric current
852 Tubular motor
854 Tube
856 Fixed element
858 Guiding element
860 Shielding element
900 Apparatus
904 Computer
962 Development unit
964 Third party
966 Service operator
968 User

The invention claimed is:

1. A monitoring system comprising:

one or more apparatuses for opening and closing an opening, each apparatus comprising:

a shielding element configured to be in a first state in which said opening is covered by said shielding element and thereby closed, and a second state in which said opening is uncovered by said shielding element;

a motor configured to drive said shielding element between said first and second state, said motor being provided with a thermal circuit breaker;

a plurality of sensor arrangements; and a condition monitoring device configured to receive sensor data from at least one of said plurality of sensor arrangements;

an on-site data node configured to receive the sensor data from the condition monitoring device of each of said one or more apparatuses, and to transmit reference data to the condition monitoring device of each apparatus of said one or more apparatuses; and an external database configured to receive the sensor data from the condition monitoring device of each of said one or more apparatuses or from the on-site data node, and to transmit the reference data to the condition monitoring device of each of said one or more apparatuses or to the on-site data node, wherein at least one of the plurality of sensor arrangements of each of said one or more apparatuses is a temperature sensor configured to determine a temperature in the motor and, thereby, detecting the state of said thermal circuit breaker, wherein the temperature sensor is positioned inside the motor, wherein the condition monitoring device of each of said one or more apparatuses is configured to receive sensor data from the plurality of sensor arrangements, wherein the sensor data received from the temperature sensor represents the temperature in the motor, and wherein the condition monitoring device is configured to directly or indirectly compare said sensor data with the reference data, being received from the on-site data node and/or the external database, such that a service need and/or a safety issue can be identified, and wherein the condition monitoring device of each apparatus of said one or more apparatuses is further configured to transmit the received sensor data to at least one of the on-site data node or the external database, wherein at least one of the on-site data node or the external database is configured to store the received sensor data.

2. The monitoring system according to claim 1, wherein at least one of said plurality of sensor arrangements is capable of detecting a vertical position of said shielding element.

3. The monitoring system according to claim 1, wherein each of said one or more apparatuses comprises a fixed element attached to a surface and placed above a window or doorway opening, and wherein at least one of said plurality of sensor arrangements is capable of detecting an inclination of said fixed element about at least one axis.

4. The monitoring system according to claim 3, wherein each of said one or more apparatuses comprises a roller connected to said fixed element, and wherein at least one of said plurality of sensor arrangements is capable of detecting a position of said roller relative said fixed element.

5. The monitoring system according to claim 1, further comprising a first guiding element and a second guiding element, and wherein at least one of said plurality of sensor arrangements is capable of detecting a position of said shielding element along at least one horizontal axis relative to at least one of said first guiding element and said second guiding element.

6. The monitoring system according to claim 1, further comprising a switch for controlling said motor, wherein at least one of said plurality of sensor arrangements is capable of detecting a signal failure between said switch and said motor.

7. The monitoring system according to claim 1, wherein at least one of said plurality of sensor arrangements is capable of detecting a number of starts and/or stops and/or time of operating of said motor.

8. The monitoring system according to claim 1, wherein at least one of the plurality of sensor arrangements is an electric current sensor configured to determine an electric current fed to the motor.

9. The monitoring system according to claim 1, wherein at least one of the plurality of sensor arrangements is a vibration sensor configured to determine a vibration of the apparatus.

10. The monitoring system according to claim 1, wherein the plurality of sensor arrangements is configured to determine a state of at least one of a circuit switch, a remote controller, a radar controller, a safety edge, a photocell, a limit switch, and a kill switch.

11. The monitoring system according to claim 1 comprising at least two of the apparatuses for opening and closing an opening, said at least one on-site data node being configured to communicate with said condition monitoring device of each of the apparatuses for opening and closing an opening, and to communicate with said external database.

12. The monitoring system according to claim 1, wherein the motor is arranged inside of a roller attached to the shielding element.

13. The monitoring system according to claim 11, wherein for each of the apparatuses for opening and closing an opening, the motor is arranged inside of a roller attached to the shielding element.

* * * * *